US005220844A

United States Patent [19]

Mills

[11] Patent Number: 5,220,844

[45] Date of Patent: Jun. 22, 1993

[54] INFINITE POSITION MOUNTING FLANGE

[75] Inventor: Floyd D. Mills, Valois, N.Y.

[73] Assignee: Ingersoll-Rand Company, Woodcliff, N.J.

[21] Appl. No.: 909,476

[22] Filed: Jul. 6, 1992

[51] Int. Cl.[5] ..... F02N 11/00

[52] U.S. Cl. ..... 74/6; 74/7 R; 248/666

[58] Field of Search ..... 74/6, 7 R, 7 A; 123/179.23; 248/666, 674; 310/91

[56] References Cited

U.S. PATENT DOCUMENTS

| | | | |
|---|---|---|---|
| 1,273,170 | 7/1918 | Fisher | 248/669 |
| 2,460,502 | 2/1949 | Heintz | 74/6 X |
| 2,481,783 | 9/1949 | Robinson et al. | 74/6 |
| 3,395,594 | 8/1968 | Blair | 310/91 X |
| 3,664,201 | 5/1972 | Vogel et al. | 74/6 |
| 4,273,085 | 6/1981 | Janik, Jr. | 123/179.31 |
| 4,362,065 | 12/1982 | Baratti | 74/7 |
| 4,553,442 | 11/1985 | Mazzorana | 74/7 |
| 4,931,680 | 6/1990 | Sugiyama | 310/83 |
| 4,955,343 | 9/1990 | Ogami | 123/195 |
| 5,036,213 | 7/1991 | Isozumi | 74/6 X |

*Primary Examiner*—Allan D. Herrmann
*Assistant Examiner*—David W. Laub
*Attorney, Agent, or Firm*—Walter C. Vliet

[57] ABSTRACT

A rotatable flange device for mounting a starter to an engine thereby permitting ready orientation of the starter and associated connections to adapt the starter configuration to a wide variety of engines, mounting positions, and vehicles.

7 Claims, 1 Drawing Sheet

INFINITE POSITION MOUNTING FLANGE

BACKGROUND OF THE INVENTION

This invention relates generally to engine starter mounting devices and more particularly to a rotatable mounting flange which permits universal orientation of the starter relative to the engine.

In the past, mounting flanges for starters have been an integral part of the starter housing thus limiting the number of engines and applications for a given starter. More recently, starter manufacturers have attached the flange with a number of capscrews to the main housing thus allowing a finite number of position orientations (usually 4 to 16). This often results in less than ideal plumbing of the starter resulting in supply lines at odd angles.

The foregoing illustrates limitations known to exist in present starter mounting flange art. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a device for mounting a starter comprising a compression ring adapted to be secured to a starter; the compression ring being further characterized by a circumferential land on its periphery; and a mounting flange for mounting the starter to an engine securingly engaged in compression between the land and the starter as a means for selectively positioning the starter in any rotation in relation to the engine.

The foregoing and other aspects of the present invention will become apparent from the following detailed description of the invention when considered in conjunction with the accompanying drawing figures.

BRIEF DESCRIPTION OF THE DRAWING FIGURES

FIG. 1 is a partial cross sectional view illustrating an embodiment of the device for mounting a starter according to the present invention.

DETAILED DESCRIPTION

Figure 1:
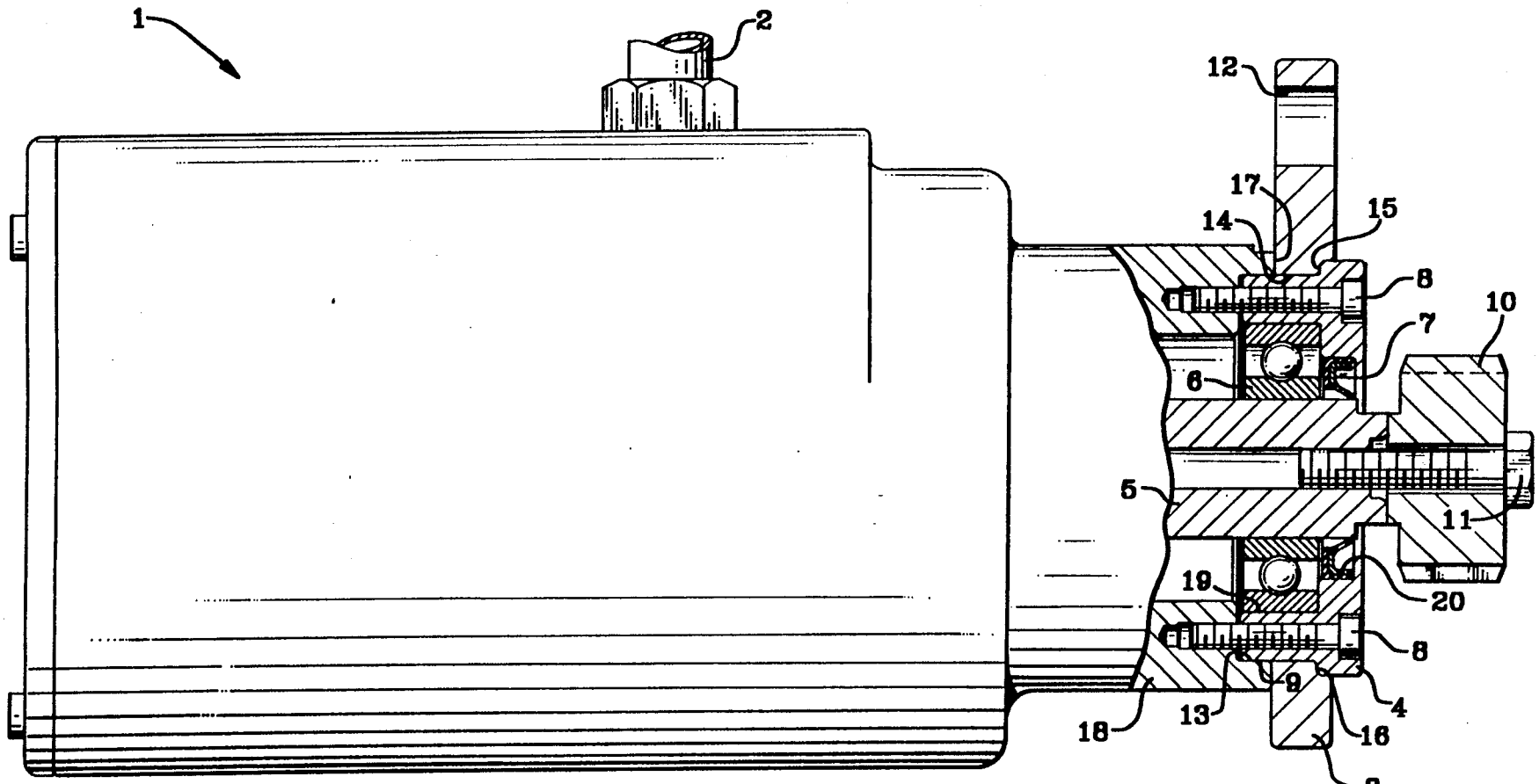

Referring to FIG. 1, an engine starter according to the present invention is generally depicted by reference numeral 1. Typically, starters are in generally cylindrical form having a power connection 2 provided to supply motive fluid to the starter. In the case of a preferred embodiment shown, the motive fluid may be supplied in the form of a pressure fluid, such as compressed air. This may be supplied by a piping connection 2 as shown.

In a typical starter, the pressure fluid would be expanded in a motor which, when activated, has its output on a rotating pinion shaft 5, as shown partially sectioned in FIG. 1. The rotary output of the pinion shaft 5 is transferred to a pinion gear 10 secured to the shaft by means of threaded nut 11 which in turn selectively contacts a gear (not shown) adapted to drive the engine in rotation.

Alternate forms of engagement between the pinion gear 10 and the engine gear are well known in the art and include means of moving the pinion into engagement by means of Bendix centrifugal engagement drives of alternative means of translating the pinion shaft into an engagement position. For purposes of the present invention, it may be assumed that the pinion shaft is translated axially into engagement during the starting cycle and is withdrawn once the engine has started.

A mounting flange 3 is provided to secure the starter to the engine by means of, for example, inserting a plurality of mounting bolts through a plurality of mounting bolt holes 12 which secure the mounting flange 3 to the engine.

According to the present invention, means are provided to permit the selective rotation of the mounting flange 3 about the starter thereby permitting orientation of the starter and its power connection 2 in any selected orientation about the mounting flange 3. This is accomplished by providing a compression ring or clamp ring 4 which as shown is in a generally circular ring form.

The clamp ring 4 is provided with a circumferential land 9 which cooperates with a bore 13 in the starter casing 18 to concentrically position the clamp ring in the starter housing. The circumferential land further cooperates with a flange bore 14 to concentrically orientate the mounting flange relative to the clamp ring 4 and thereby the starter housing.

The clamp ring 4 is further provided with a step or boss 15 which coacts with a step bore 16 in the mounting flange 3 to axially secure the mounting flange 3 in compression against a starter casing end face 17. The mounting flange 3 is secured to the starter housing 18 by means of a plurality of capscrews 8.

The mounting flange is further provided with an internal bearing bore 19 which accepts a bearing 6. The bearing 6 centralizes the pinion shaft 5 and permits its rotation within the starter housing 18. A seal bore 20 is further provided in the mounting flange 3 for accepting a seal 7 which prevents foreign matter from entering the interior of the starter housing 18.

It should be appreciated by one skilled in the art that the compression ring or clamp ring 4 performs several useful functions in permitting universal orientation of the mounting flange 3 and subsequently retaining it in the selected position by clamping it against the face of the starter. In addition, the compression ring 4 serves as a retainer for both the bearing and seal assemblies, thereby permitting ready assembly of the components forming the starter front end.

Having described the invention, what is claimed is:

1. A device for mounting and securing a starter to an engine, comprising:

a compression ring adapted to be secured to said starter;

said compression ring being further characterized by a circumferential step on its periphery; and a mounting flange rotatable about said compression ring for mounting said starter to an engine, said mounting flange being securingly engaged in compression between said step and said starter as a means for selectively positioning said starter in any selected rotation orientation in relation to said engine.

2. A device for mounting a starter according to claim 1, wherein said compression ring is threadingly secured to said starter.

3. A device for mounting a starter according to claim 2, wherein said compression ring is secured to said starter by bolts.

4. A device for mounting a starter according to claim 1, wherein said compression ring circumferential land engages a circumferential bore in a housing for said starter as a means for aligning said ring with said starter housing.

5. A device for mounting a starter according to claim 1, wherein said compression ring is further characterized as being provided with an internal bore for securing a bearing means for rotatably supporting a rotating shaft member disposed in said compression ring.

6. A device for mounting a starter according to claim 1, wherein said compression ring is further characterized as being provided with an internal seal bore for securing a seal means for preventing foreign matter from entering a starter casing.

7. A device for mounting a starter according to claim 6, wherein said rotating shaft member is a starter pinion shaft having a starter pinion gear mounted thereon.

* * * * *